US005476253A

United States Patent [19]

Takemoto et al.

[11] Patent Number: 5,476,253

[45] Date of Patent: Dec. 19, 1995

[54] PAPER SLIP TRANSPORT AND STACK UNIT

[75] Inventors: Takatoshi Takemoto; Kazunari Kawashima, both of Tokyo; Hideyuki Kadomatsu, Odawara; Moriyuki Aoyama, Okazaki; Takeharu Nakamura, Toyohashi, all of Japan

[73] Assignee: Kabushiki Kaisha Ace Denken, Tokyo, Japan

[21] Appl. No.: 256,801

[22] PCT Filed: Jan. 24, 1992

[86] PCT No.: PCT/JP92/00064

§ 371 Date: Jul. 25, 1994

§ 102(e) Date: Jul. 25, 1994

[87] PCT Pub. No.: WO93/15010

PCT Pub. Date: Aug. 5, 1993

[51] Int. Cl.[6] ..... B65H 5/22

[52] U.S. Cl. ..... 271/4.01; 271/6; 271/7

[58] Field of Search ..... 271/3, 4, 6, 7, 271/114, 116, 272, 274, 180, 212, 3.01, 4.01; 235/89 R

[56] References Cited

FOREIGN PATENT DOCUMENTS 57-151561 9/1982 Japan .
59-133554 8/1984 Japan .
61-105349 7/1986 Japan .
62-79143 4/1987 Japan .
1-156159 10/1989 Japan .
2-13561 1/1990 Japan .
2-18256 1/1990 Japan .
3232656 10/1991 Japan ..... 271/3

*Primary Examiner*—David H. Bollinger
*Attorney, Agent, or Firm*—Lowe, Price, LeBlanc & Becker

[57] ABSTRACT

A paper slip transport and stack unit is provided for separating received slips of paper into individual slips for transporting and stacking up them in an orderly manner in a stack section while counting the slips of paper by a count mechanism. The transport and stack unit includes a separation mechanism which always operates in one direction, a transport mechanism operating intermittently in one direction, and a paper slip lift mechanism in the stack section intermittently operating exclusively against the transport mechanism. The separation transport and paper slip lift mechanisms in the stack section are driven by a single drive source.

10 Claims, 7 Drawing Sheets

PAPER SLIP TRANSPORT AND STACK UNIT

TECHNICAL FIELD

This invention relates to a paper slip transport and stack unit which separates received slips of paper into individual slip for transporting and stacks up the slips of paper in a stack section in order while counting them by count means.

TECHNICAL BACKGROUND

A conventional paper slip transport and stack unit is provided with separation means always operating in one direction, transport means intermittently operating in one direction, and paper slip lift means in a stack section intermittently operating exclusively against the transport means, each of which is appropriately provided with a separate drive source.

Such a paper slip transport and stack unit often adopts a vertical structure to reduce the installation floor area of the unit; the stack section is disposed at the top and means such as the transport means to the stack section are located in the vertical direction.

Such a vertical transport section sends a slip of paper placed between a conveyor belt and a plurality of rollers in rolling contact with the conveyor belt; hitherto, such a vertical transport section has been built in the frame of the unit.

Further, a paper slip inlet in the stack section is formed with an eject roller 1 at the termination of the transport means for transferring slips of paper to the paper slip lift means while the eject roller 1 comes into rolling contact with the conveyor belt. The eject roller 1 has a structure where a cylinder 2 is formed with a large number of pins 3 in a radial manner, as shown in FIG. 9.

However, it is wasteful to provide a separate drive source for each of the separation means, the transport means, the paper slip lift means in the stack section, etc., at the paper slip transport and stack unit; it not only increases costs, but also hinders miniaturization of the unit.

At such a unit, a slip of paper being transported may cause a so-called jam to occur and become unable to be transported. Particularly, a jam is prone to occur in the vertical transport section, which transports slips of paper which are likely to fall downward while being placed between the conveyor belt and rollers. At the conventional unit, the transport section is also built into the frame of the unit. Thus, each time a jam occurs, the outer cover must be opened to take out the jammed slip of paper and moreover it is very cumbersome to take out the slip of paper placed between the belt and rollers, etc.

Further, the conventional eject roller 1 as shown in FIG. 9, which provides the pins 3 each having a small area in contact with a slip of paper, is weak in terms of a discharge force onto the paper slip lift means and a drawing force when a slip of paper is again drawn close to the upper edge part of the eject roller after it is once discharged at the lower edge part, and is not formed with an elastic member; resultantly, a stack of the preceding and following slips of paper may be placed in a disorderly manner.

DISCLOSURE OF INVENTION

It is a first object of the invention to provide a paper slip transport and stack unit which comprises a single common drive source and is inexpensive and small-sized.

It is a second object of the invention to provide a paper slip transport and stack unit in which it is easy to handle a jammed paper slip.

It is a third object of the invention to provide a paper slip transport and stack unit to prevent a stack of slips of paper from being placed out of order in a stack section.

To accomplish the first object, according to a first form of the invention, there is provided a paper slip transport and stack unit including a stack section having a casing to store slips of paper for transporting slips of paper to the stack section and storing them in the stack section in a state in which slips of paper are stacked up; the unit comprising:

means for separating received slips of paper for each slip;

means for transporting the separated slips of paper to the stack section;

means for counting the slips of paper being transported;

paper slip lift means being installed in the stack section for stacking slips of paper and pushing up a given number of the stacked slips of paper to the inside of the casing from a downward position for storing the slips of paper in the stack section;

a single drive source capable of outputting driving forces for driving the separation means, the transport means, and the paper slip lift means selectively in both forward and reverse directions; and power transmission means for transmitting the driving force output from the drive source to the separation means, the transport means, and the paper slip lift means separately, the power transmission means comprising:

a first transmission mechanism, when the drive source outputs a driving force in a forward direction, for receiving the driving force and transmitting it to the transport means;

a second transmission mechanism, when the drive source outputs a driving force in a reverse direction, for receiving the driving force and transmitting it to the paper slip lift means; and a third transmission mechanism, when the drive source outputs a driving force in a forward direction and in a reverse direction, for taking out the driving force as the driving force in the same direction and transmitting it to the separation means.

For example, a motor that can turn in both forward and reverse directions is used as the drive source.

The first transmission mechanism can have a one-way clutch for transmitting the rotational driving force only in the forward direction among rotational driving forces output from the motor.

The transport means can have a plurality of pulleys and a belt placed on the pulleys.

The rotational driving force in the forward direction is transmitted via the one-way clutch to a pulley used as a driving pulley of the pulleys.

The second transmission mechanism can have a one-way clutch for transmitting the rotational driving force only in the reverse direction among rotational driving forces output from the motor.

The paper slip lift means can have an upper plate for supporting slips of paper and a mechanism for converting the rotational driving force transmitted from the second transmission mechanism into vertical motion for vertically moving the upper plate. In this case, the rotational driving force in the reverse direction is transmitted via the one-way clutch to the mechanism for vertically moving the upper plate.

Further, the third transmission mechanism can have a first one-way clutch for transmitting the rotational driving force only in the forward direction among rotational driving forces output from the motor, a second one-way clutch for transmitting the rotational driving force only in the reverse direction among rotational driving forces output from the motor, and a mechanism for receiving the rotational driving forces transmitted via the first and second clutches as a rotational driving force in the same direction.

In this case, the rotational driving force is always transmitted to the separation means in one direction by the mechanism for receiving a rotational driving force in the same direction.

To accomplish the second object, according to a second form of the invention, the paper slip transport and stack unit according to the first form further includes a frame for housing the means with the transport means having a vertical transport section for transporting slips of paper in a substantially vertical direction.

The vertical transport section comprises a conveyor belt and a press roller unit for putting a slip of paper between the belt and the press roller unit. The press roller unit comprises a plurality of press rollers each supported on a roller shaft for pressing a slip of paper, a support plate mounted detachably on the frame for supporting the roller shafts of the press rollers movably to the conveyor belt, press springs each installed for each of the roller shafts and engaging the roller shaft corresponding thereto for energizing the roller shaft toward the conveyor belt, and a slide plate engaging the support plate for placing the press springs in an energization state when the roller unit is fitted into the frame and for releasing the energization state when the press roller unit is removed from the frame.

Further, to accomplish the third object, according to a third form of the invention, the paper slip transport and stack unit in the first form further includes an eject roller installed at the termination of the transport means for transferring slips of paper to the paper slip lift means while coming into rolling contact with the conveyor belt, and an elastic member disposed in parallel to the eject roller for springing up the rear end of a slip of paper to put the slip of paper under the preceding slip of paper while guiding slips of paper from the rear end of the transport means. The eject roller is made of a grooved elastic material having high friction.

Thus, slips of paper transferred to the transport and stack unit are separated into individual slips by the separation means always operating in one direction and transported to the stack section by the transport means.

In the stack section, the eject roller comes into rolling contact with the conveyor belt for discharging a slip of paper onto the paper slip lift means. At this time, the rear end of the slip of paper is sprung up by the elastic member and pulled back by rotation of the eject roller. Thus, the slip of paper is stacked in a slant condition so that the subsequent slip of paper is placed underneath. The subsequent slips of paper is placed under the slip of paper in the slant condition one after another for stacking.

Since the eject roller is made of grooved elastic material having high friction, the stacking operation is performed securely, for stacking up slips of paper in an orderly fashion.

When a large number of slips of paper are stacked on the lift means, it becomes difficult to hold the slips of paper in the slant condition and advancing the subsequent slips of paper is hindered. Therefore, every given number of slips of paper, the paper slip lift means temporarily stores the stacked slips of paper in the upper portion of the stack section.

When the paper slip lift means operates, the transport means temporarily stops operation. This is because the driving direction of the drive source is inverted. However, at least a part of the separation means continues to operate at all times.

When the paper slip lift means returns to the origin position, the operation of the transport means is restarted and the stacking operation of paper slips on the paper slip lift means is restarted.

When a jam occurs in the vertical transport section in which a jam is particularly prone to occur in the passage of the transport means, the press roller unit for pressing the conveyor belt is removed from the frame of the transport and stack unit. While the press springs are released, the press roller unit is removed from the frame, enabling the jammed slip of paper to be promptly excluded.

After the jammed slip of paper has been handled, the press roller unit is fitted into the frame. The slide plate causes the press springs to press the roller shafts for again joining the press rollers to the conveyor belt face, enabling a slip of paper to be placed therebetween.

BEST MODE FOR CARRYING OUT THE INVENTION

Referring now to the accompanying drawings, there is shown a first embodiment of the invention.

Figure 1:
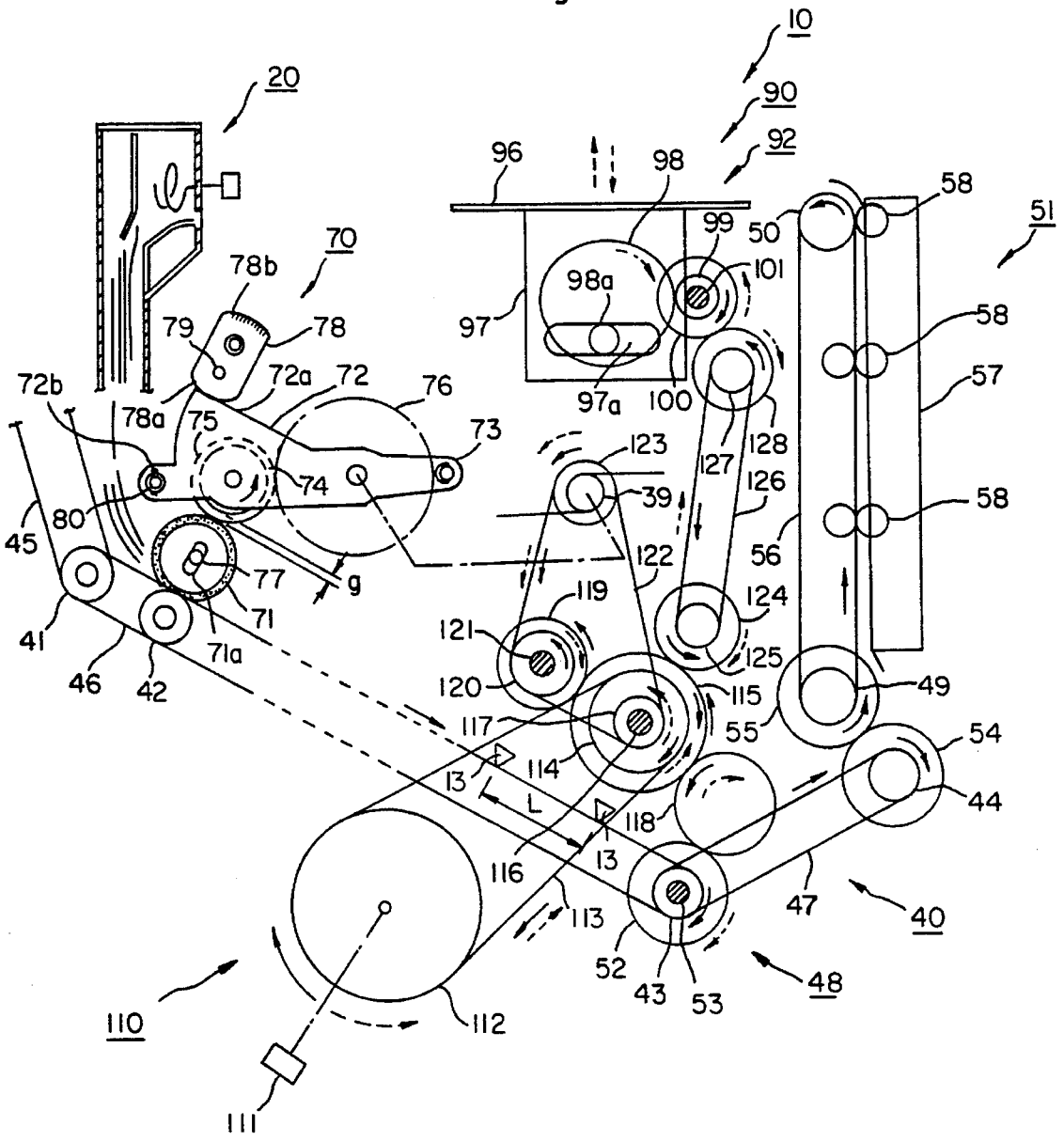
FIG. 1 is an illustration showing the structure of a paper slip transport and stack unit according to a first embodiment of the invention.

A paper slip transport and stack unit 10 comprises a reception section 20 for receiving slips of paper sent from terminals (not shown) through which the slips of paper are entered and discharging them to a downstream transport means 40, transport means 40, separation means 70 located very close to the entrance of the transport means 40, a stack section 90 for stacking up slips of paper tidily and taking out them, and a drive section 110, as shown in FIG. 1.

Figure 2:
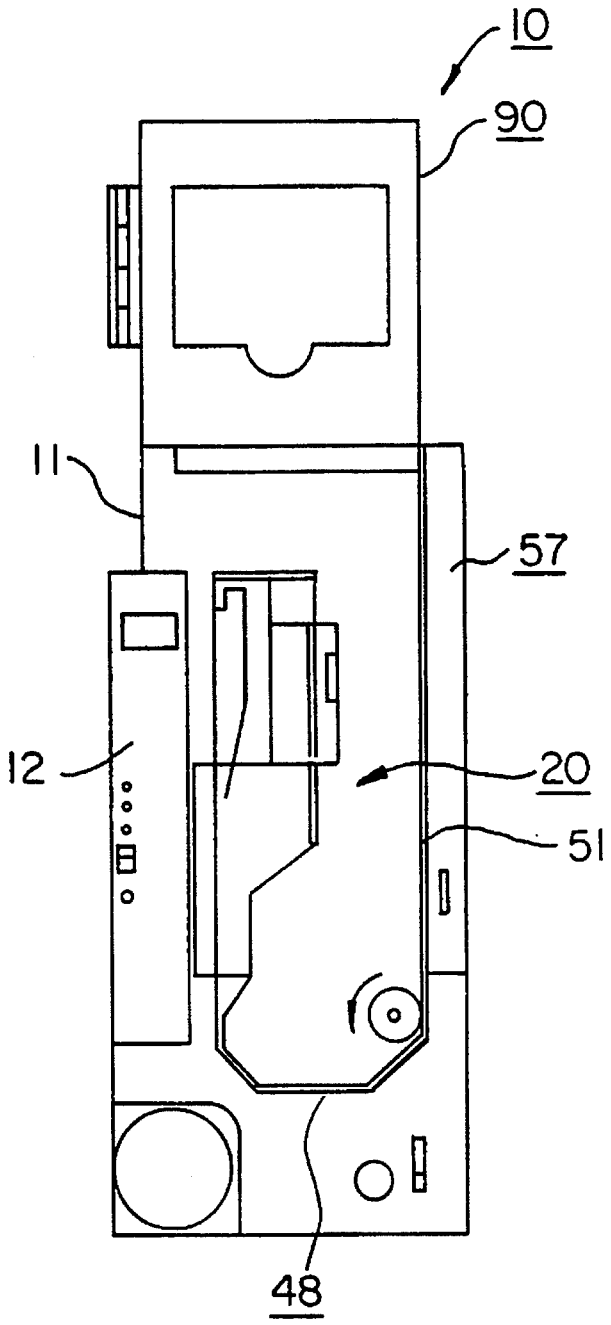
FIG. 2 is a front view of the appearance of the transport and stack unit in FIG. 1.

The unit 10 has a vertical structure, as shown in FIG. 2; the reception section 20 of slips of paper sent from the rear of the figure is disposed substantially at the center of the figure and on the left end on the front of the unit, a control and power section 12 is housed in a box for facilitating internal inspection. The stack section 90 is located at a position where slips of paper on the top can be easily taken out.

The transport means 40 falls away from the reception section 20 and rises vertically along the side wall of a frame 11 to the stack section 90.

The structure of the unit will be discussed in more detail in conjunction with FIG. 1. The transport means comprises a first transport section 48 consisting of three conveyor belts 45, 46, and 47 placed on a plurality of pulleys 41, 42, 43, 44, etc., and a second transport section 51, a vertical transport section placed on pulleys 49 and 50 disposed on the top and bottom of the frame 11.

The pulley 43 in the first transport section 48 is linked to a gear 52 on the same shaft. In response to rotation of the gear 52 in the solid line direction, the pulley 43 is rotated in the same direction by means of a one-way clutch and no turning force is transmitted in the broken line direction in FIG. 1.

A pair of paper slip detection sensors 13, 13 making up count means are located along the conveyor belt 46. The spacing between the two sensors 13 and 13, L, is made slightly longer than the length of a slip of paper.

Figure 3:
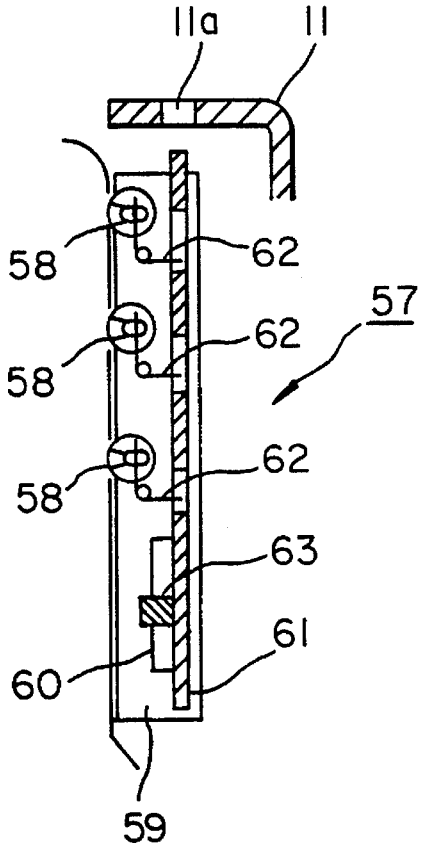
FIG. 3 is a vertical sectional view of a press roller unit in a vertical transport section.
Figure 4:
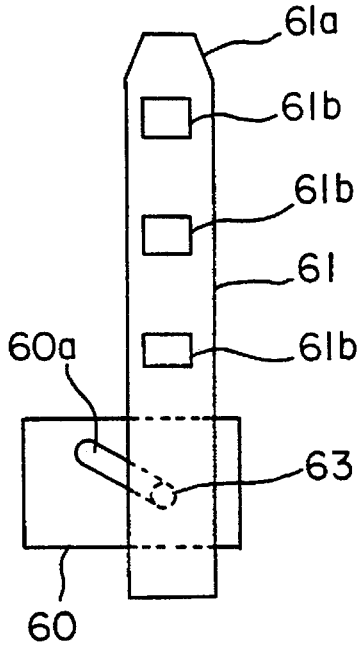
FIG. 4 is an illustration showing the engagement relationship between a slide plate and a lock plate in the press roller unit.

A driving force is transmitted from a gear 54 in the first transport section 48 to a gear 55 for operating the second transport section 51, which comprises a conveyor belt 56 placed on the pulleys 49 and 50 and a press roller unit 57, as shown in FIG. 3, for pressing the conveyor belt 56.

As shown in FIG. 3, the press roller unit 57 comprises a support plate 59 for supporting a plurality of press rollers 58 movably to the conveyor belt 56, a slide plate 61 engaging a lock plate 60 of the support plate 59, and press springs 62 for pressing the press rollers 58 against the conveyor belt 56.

The slide plate 61 is formed with a pin 63 which engages with a slant groove 60a of the lock plate 60. The slide plate 61 rises by pushing the support plate 59 in a lateral direction and a tip 61*a* engages with a lock hole 11*a* of the frame.

Figure 5:
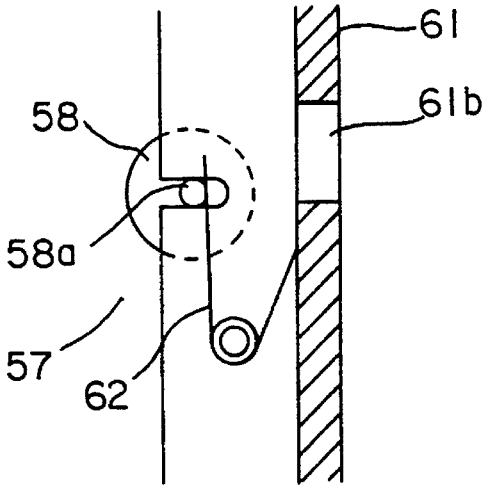
FIG. 5 is an operation illustration showing a state in which a press roller is energized.

A plurality of small holes 61*b* are pierced in the slide plate 61 and one end of each press spring penetrates into the small hole 61*b*. When the slide plate 61 rises, the press spring 62 is bent, as shown in FIG. 5, to achieve an energizing force to a roller shaft 58*a* of the press roller 58.

Figure 6:
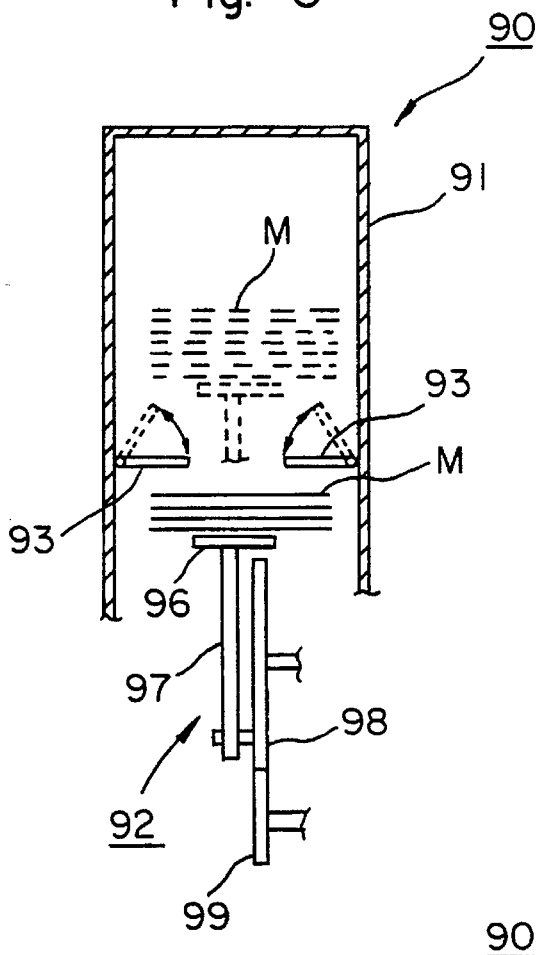
FIG. 6 a vertical sectional view of a transport section.
Figure 7:
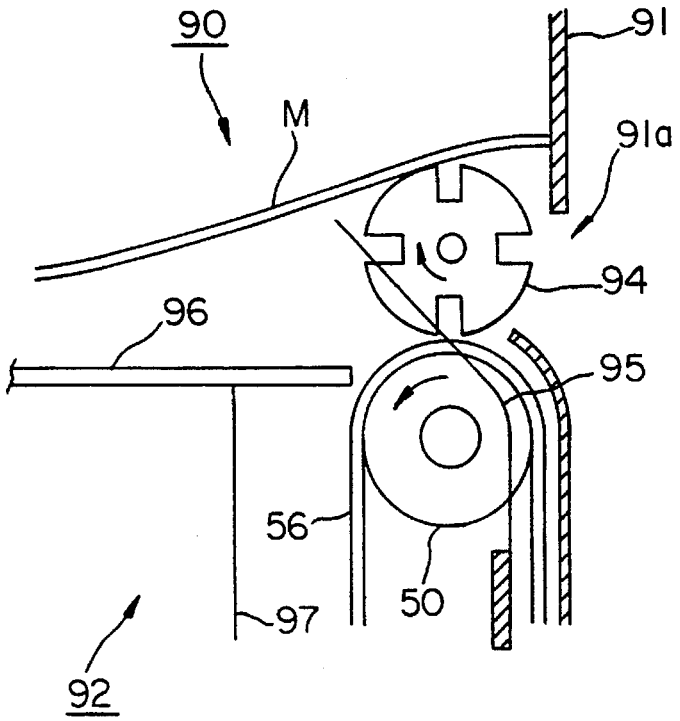
FIG. 7 is an operation illustration of an eject roller in the stack section.

As shown in FIG. 6, the stack section 90 comprises paper slip lift means 92 vertically movable in a casing 91, a pair of paper slip shelves 93, 93, an eject roller 94, as shown in FIG. 7, installed at a paper slip inlet 91*a* in the stack section 90, and an elastic member 95 located parallel to the eject roller 94.

As shown in FIGS. 1 and 6, the paper slip lift means 92 comprises an upper plate 96 horizontally placed and a drive plate 97 secured in a direction perpendicular to the upper plate 96 and formed with an oblong engagement groove 97*a*. A pin 98*a* formed on a gear 98 for transmitting a driving force is slidably fitted.

The gear 98 meshes with a gear 99, which is linked via a one-way clutch 101 to a gear 100 receiving a turning force from the drive section 110 described below, on the same shaft.

When the gear 100 rotates in the broken line direction, the one-way clutch 101 is placed in engagement with the gear 99; when the gear 100 rotates in the solid line arrow direction, the clutch is placed out of engagement with the gear 99.

Each of the paper slip shelves 93 in the casing 91 is mounted swingably, to a position almost 90° upward from the horizontal position, so that a space is provided between the left and right paper slip shelves 93 and 93 to enable the upper plate 96 of the paper slip lift means 92 to fully pass therethrough.

The eject roller 94 installed at the entrance of the stack section 90 is in contact with the rear end of the conveyor belt 56 in the second transport section 51 for receiving a turning force and rotating clockwise as shown in FIG. 7. A slip of paper is first transferred to the inside by the rotation, then the rear end of the slip of paper is drawn near by the same rotation, the slip of paper is held on the top of the eject roller 94, as shown, and the following slip of paper is put under the preceding slip of paper.

Figure 8:
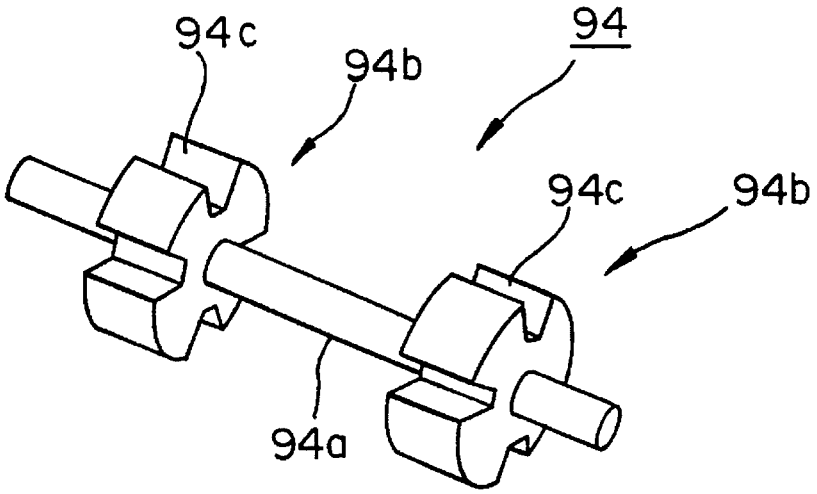
FIG. 8 is a perspective view of the eject roller.
Figure 9:
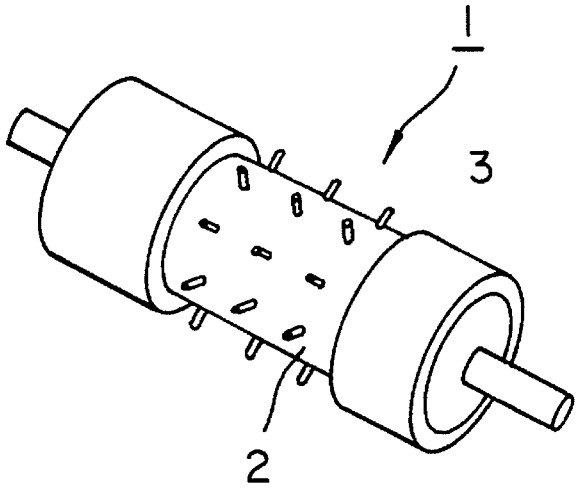
Fig. 9 PRIOR ART
FIG. 9 is a perspective view of a conventional eject roller.

As shown in FIG. 8, the eject roller 94 comprises a shaft 94*a* and a pair of roller bodies 94*b* made of elastic material having high friction, such as rubber material, and formed with a plurality of deep grooves 94*c* in a direction perpendicular to the rotation direction, as shown.

The elastic member 95, which is located in parallel to the eject roller 94 for springing up the rear end of a paper slip transferred to the stack section 90, is extended from the side of the second transport section 51 and bent toward the inside of the casing 91 and has a free end oriented diagonally upwards, as shown in FIG. 7. Preferably, the material of the elastic member is a elastic plastic or stainless thin plate.

As shown in FIG. 1, the separation means 70 comprises a first friction roller 71 detachably mounted on the conveyor belt 46 in the first transport section 48 and a second friction roller 74 which is in timely contact with the first friction roller 71 for transmitting a turning force and is pivotally supported by a support arm 72 swingably pivoted to the swing shaft 73.

A gear 75 is linked to the second friction roller 74 on the same shaft and meshes with a gear 76 for transmitting a unidirectional turning force from the drive section 110 described below.

A predetermined minute gap g is provided between the first friction roller 71 and the second friction roller 74 and is set to a value larger than the thickness of one slip of paper and smaller than the thickness of two slips of paper.

The first friction roller 71 has a shaft hole 71*a* formed as a long hole and swings so as to be in contact with either the conveyor belt 46 or the second friction roller 74 in the predetermined gap g with the pivot 77 as the center.

An adjustment cam 78 is located as means for adjusting the predetermined gap g.

The adjustment cam 78 swings with a shaft 79 as the center and a cam face 78*a* is in contact with a contact face 72*a* of the support arm 72 for pressing it downward. On the other hand, the support arm 72 is energized upwards in FIG. 1 by energization means (not shown) and a small fixing screw 80 is disposed at a long hole 72*b* pierced in the end at the position symmetrical with the swing shaft 73.

The adjustment cam 78 is provided with graduation 78*b* for indicating an adjustment amount as shown in FIG. 1.

The drive section 110 comprises a drive motor 111 as a single drive source and is linked to a driving pulley 112.

The driving pulley 112 drives a driven pulley 114 via a drive belt 113. The driven pulley 114 is linked to a gear 115 on the same shaft and further with a pulley 117 via a one-way clutch 116 on the same shaft.

As shown in FIG. 1, the driving pulley 112 rotates in both directions denoted by solid ;line and broken line arrows as the drive motor 111 turns forwards and backwards; likewise, the driven pulley 114 also rotates in both directions denoted by solid line and broken line arrows as shown. Likewise, the gear 115 also rotates in both directions. However, the pulley 117 is adapted to rotate only in the broken line arrow direction by means of the one-way clutch 116.

The gear 115 meshes with the gear 52 in the first transport section via an intermediate gear 118 and also meshes with a gear 119.

The gear 119 is linked to a pulley 120 via a one-way clutch 121 on the same shaft and the pulley 120 rotates only in the solid line arrow direction in response to bidirectional rotation of the gear 119.

The pulleys 117 and 120 are connected to a driving pulley 123 of an impeller 39 via a belt 122. The belt 122 rotates only in one direction as shown in FIG. 1 by the functions of the one-way clutches 116 and 121, as described above.

The impeller 39 is actually disposed at a part of the reception section 20, but is shown at the distant position as in FIG. 1 for the convenience of representation on the drawing.

Next, the operation of the unit will be discussed.

In FIG. 1, as the drive motor 111 turns forwards and backwards, the driving pulley 112 rotates in both solid and broken line arrow directions as shown. In response to the operation, the driven pulley 114 also rotates in both directions via the drive belt 113. The gear 52 in the first transport section 48 is also driven in both directions via the intermediate gear 118 by the gear 115 on the same shaft. However, on the same shaft, the one-way clutch 53 causes the pulley 43 to rotate only in the solid line arrow, namely, clockwise; resultantly, the first transport section 48 transports slips of paper only in the direction from left to right shown in FIG. 1.

In contrast, when the drive motor 111 turns in the broken line direction, the one-way clutch 43 is released, during which period the first transport section 48 stops the transport operation of slips of paper. This means that the first transport section 48 is adapted to perform intermittent transport operation.

Since the operation of the first transport section 48 is transmitted to the gear 55 in the second transport section 51 via the gear 54, the second transport section 51 also performs similar intermittent operation in synchronization with the first transport section 48.

In the second transport section 51, slips of paper are put between the conveyor belt 56 and the press roller 58 of the press roller unit 57 and are sent in the vertical direction.

When a paper jam occurs in the second transport section 51, the slide plate 61 of the press roller unit 57 is pulled out from the lock hole 11a of the frame 11 and while the pin 63 of the side plate 61 is slid along the slant groove 60*a*, the pressure of the press spring 62 is loosened and the entire unit 57 is removed from the frame 11. Then, the jammed paper slip can be easily taken out intact.

The slip of paper elevated in the second transport section 51 is caught in the eject roller in the stack section 90 at the termination of the conveyor belt 56 and is initially carried into the casing 91, but strikes against the opposite wall (not shown in FIG. 7). The rear end of the slip of paper is lifted upward by the rotation of the eject roller 94 and the spring force of the elastic member 95 and the slip of paper is held in a state in which it is inclined so as to rise gradually to the right as shown in FIG. 7. The subsequent slip of paper is put under the preceding slip of paper and stacked up on the upper plate 96 of the paper slip lift means 92.

On the other hand, the gear 115 in the drive section 110 transmits rotation via the gear 124, the pulley 125, the belt 126, the pulley 127, and the gear 128. Since the gear 99 in the stack section 90 is linked to the gear 100 via the one-way clutch 101, the rotation of the gear 100 only in the broken line arrow direction in FIG. 1 is transmitted to the gear 99 and in the end, the gear 98 for operating the paper slip lift means 92 rotates only clockwise as shown in FIG. 1.

By the way, slips of paper M are stacked up on the upper plate 96 of the paper slip lift means 92 as described above and when they reach a given number of slips, the slips of paper cannot maintain the inclined state being raised to the right. Then, the operation of the first and second transport sections 48 and 51 for transporting and carrying the slips of paper into the stack section 90 is stopped when the drive motor 111 stops, and the drive motor 111 starts turning reversely, namely, in the broken line arrow direction shown in FIG. 1.

When the drive section 110 rotates reversely, as described above, the first and second transport sections 48 and 51 continue to stop the transport operation; on the other hand, as the gear 98 rotates, the pin 98*a* moves in the engagement groove 97*a* of the drive plate 97 for moving the paper slip lift means 92 up and down only once. The vertical move operation is described in conjunction with FIG. 6. As the paper slip lift means 92 is elevated, the slips of paper M on the upper plate 96 push and open the paper slip shelves 93 upwardly. At this time, the slips of paper M already stacked up on the paper slip shelves 93 are also lifted up. When they become as indicated by the broken lines in FIG. 6, the paper slip shelves 93, 93 automatically fall back and are restored to the original level state. When the paper slip lift means 92 falls, the slips of paper M on the upper plate 96 are left on the paper slip shelves 93; only the paper slip lift means 92 falls and is restored to the original position.

When the slips of paper M on the upper plate 96 are handled as described above land the paper slip lift means 92 falls, the drive motor 111 again starts forward rotation (in the solid line arrow direction in FIG. 1) for performing the transport operation and stacking operation of slips of paper on the upper plate 96 in the stack section 90.

In the separation means 70, the second friction roller 74 always rotates in one direction, namely, counterclockwise in FIG. 1 when the drive motor 111 turns forward and reversely.

When one slip of paper is inserted under the first friction roller 71, the roller 71 is lifted up by thickness of the one slip of paper, but the predetermined gap between the first friction roller 71 and the second friction roller 74, g, is provided larger than the thickness of one slip of paper, so that both the rollers 71 and 74 are out of contact with each other and the slip of paper is transported downstream on the conveyor belt 46.

If two or more slips of paper are inserted, the predetermined gap g is smaller than the thickness of the two slips of paper, so that the first friction roller 71 comes into contact with the second friction roller 74 and is rotated clockwise as shown in FIG. 1. The upper slip of paper being contact with the first friction roller 71 is pushed back upstream and only the first slip of paper in contact with the conveyor belt 46 is transported downstream.

Next, a second embodiment of the invention will be discussed.

The second embodiment is the same as the first embodiment except for positions of paper slip detection sensors 13, 13 and parts identical with those previously described in the first embodiment will not be discussed again.

Figure 10:
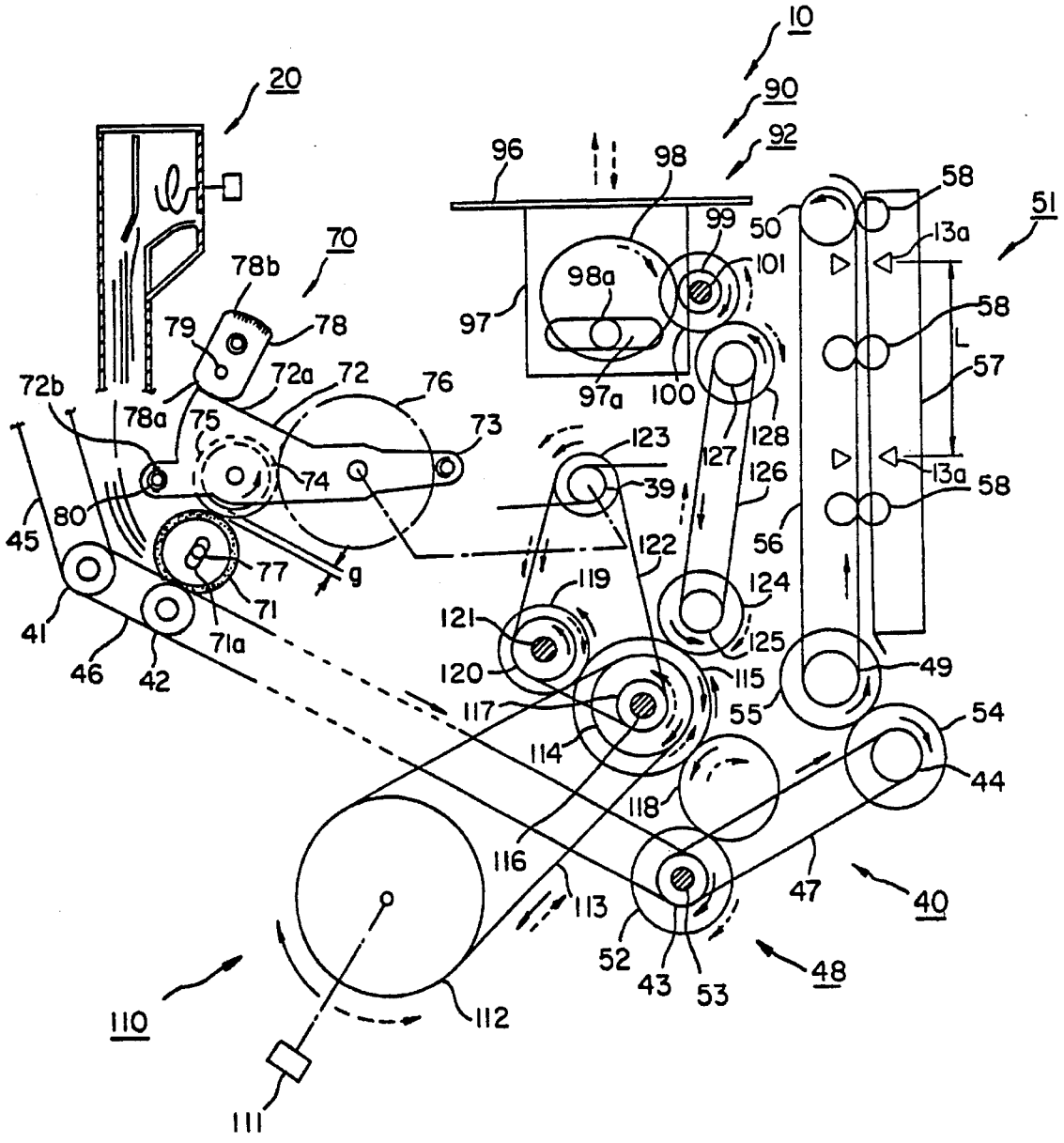
FIG. 10 is an illustration showing the structure of a paper slip transport and stack unit according to a second embodiment of the invention.
Figure 11:
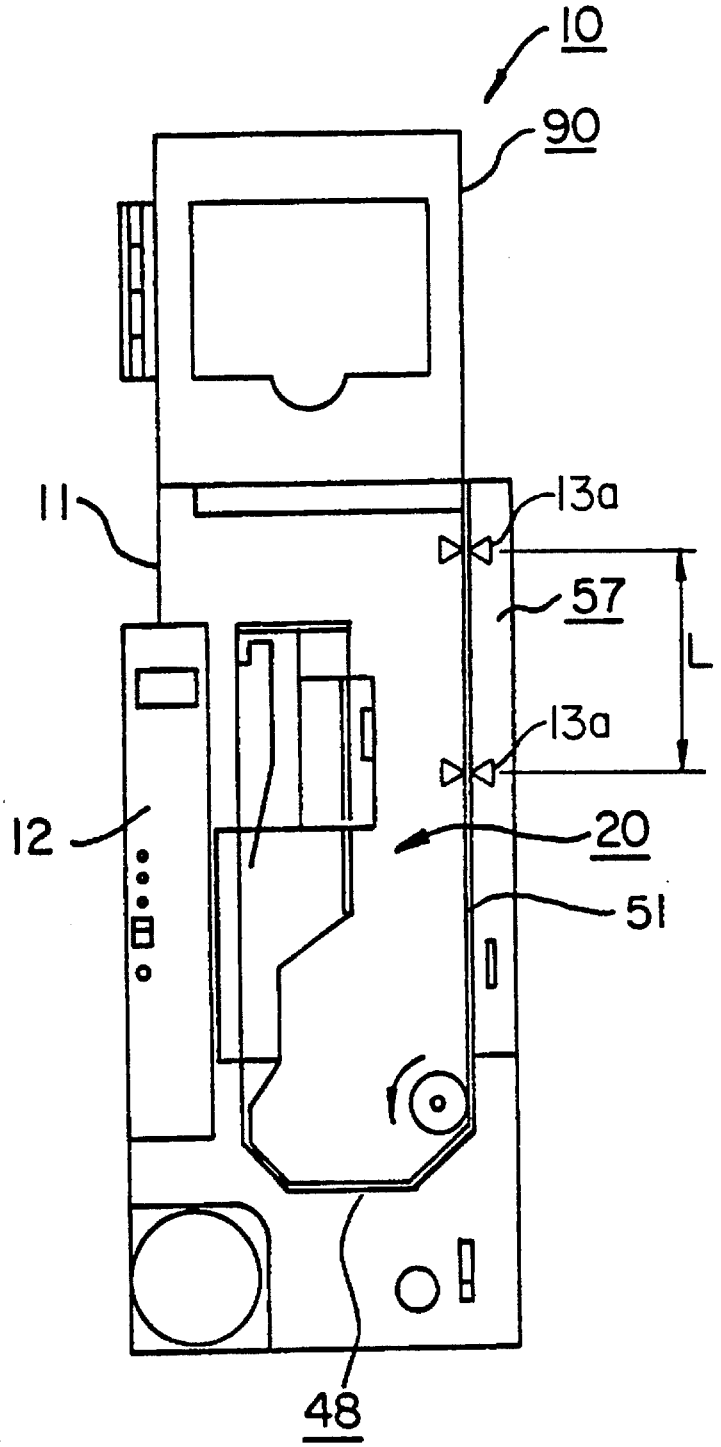
FIG. 11 is a front view of the appearance of the transport and stack unit in the second embodiment.

As shown in FIGS. 10 and 11, the paper slip detection sensors 13, 13 making up count means are located along a conveyor belt 56. The spacing between the sensors 13 and 13, L, is formed slightly longer than the length of a slip of paper. For example, if the slip of paper is a bill, the spacing L is set to the length of a bill plus ¿~& ¿, more specifically, 153 mm long.

Next, the operation will be discussed.

Since slips of paper being transported are counted at the final position around the entrance of a stack section 90, they will be sent to the stack section 90 immediately after the slips of paper are counted by means of the paper slip detection sensors 13*a*, 13*a*. Thus, as compared with the case where slips of paper are counted at a position near the reception section 20, trouble or the like after counting is less likely to occur, thereby preventing a problem from occurring, such as an insufficient count in which the count of slips of paper does not match the number of slips of paper actually sent to the stack section 90 due to occurrence of a fault or the like after the counting. If a problem occurs before a slip of paper passes through the paper slip detection sensors 13*a*, 13*a*, the paper slip detection sensors 13*a*, 13*a*, do not switch on or off, thus an error in computer output signals, etc., output from the paper slip detection sensors 13*a*, 13*a*, to a computer does not occur.

FIELD OF INDUSTRIAL APPLICATION

According to the paper slip transport and stack unit of the invention, the separation means always operating in one direction, the transport means intermittently operating in one direction, and the paper slip lift means in the stack section intermittently operating exclusively against the transport means are driven by a single drive source, so that the transport and stack unit can be manufactured at low costs and moreover can provide a simple layout for miniaturization.

The transport and stack unit has the vertical transfer section in which the rollers for placing slips of paper between the conveyor belt and the rollers are put into a unit which is mounted detachably on the main unit, thus steps to handle a jammed paper slip in the vertical transport section which is prone to cause a paper jam to occur can be taken promptly, preventing the delay of these steps, which may result in a large amount of jammed paper and minimizing the down time of the transport and stack unit.

Further, the stack section is provided with the eject roller made of grooved elastic material having high friction through which slips of paper are transferred from the transport means and the elastic member disposed in parallel with the eject roller for springing up the rear end of a transferred slip of paper. Thus, the rear of the preceding slip of paper is sufficiently opened so that the subsequent slip of paper can be placed securely underneath and the stack operation in the stack section is performed in an orderly way.

We claim:

1. A paper slip transport and stack unit, including a stack section having a casing for storing slips of paper, for transporting slips of paper to the stack section and storing them in the stack section in a state in which a given number of slips of paper are stacked up, said unit comprising:

means for separating received slips of paper into individual slips;

means for transporting the separated slips of paper to said stack section;

means for counting the slips of paper being transported;

paper slip lift means, installed in said stack section for stacking slips of paper, for pushing up a selected number of the stacked slips of paper to an inside of the casing from a downward position for storing the slips of paper in said stack section;

a single drive source capable of outputting driving forces for driving said separation means, said transport means, and said paper slip lift means selectively in both forward and reverse directions; and power transmission means for transmitting the driving force output from said drive source to said separation means, said transport means, and said paper slip lift means separately, said power transmission means comprising a first transmission mechanism, operative when said drive source outputs a first driving force in a forward direction, for receiving the first driving force and transmitting it to said transport means;

a second transmission mechanism, operative when said drive source outputs a second driving force in a reverse direction, for receiving the second driving force and transmitting it to said paper slip lift means; and a third transmission mechanism, operative when said drive source outputs a third driving force in one of a forward direction or a reverse direction, for receiving and transmitting the third driving force in said one of a forward direction or a reverse direction and transmitting the same to said separation means.

2. The paper slip transport and stack unit as claimed in claim 1, wherein:

said drive source is a motor that can rotate to provide rotational driving forces in both forward and reverse directions.

3. The paper slip transport and stack unit as claimed in claim 2, wherein:

said first transmission mechanism has a one-way clutch for transmitting a rotational driving force only in the forward direction among rotational driving forces output from said motor; and said transport means has a plurality of pulleys and a belt placed on said pulleys, the rotational driving force in the forward direction being transmitted via said one-way clutch to a pulley used as a driving pulley of said plurality of pulleys.

4. The paper slip transport and stack unit as claimed in claim 3, wherein:

said second transmission mechanism has a one-way clutch for transmitting the rotational driving force only in the reverse direction among rotational driving forces output from said motor, and said paper slip lift means has an upper plate for supporting slips of paper and a mechanism for converting the rotational driving force transmitted from said second transmission mechanism into vertical motion for vertically moving said upper plate, the rotational driving force in the reverse direction being transmitted via said one-way clutch to said mechanism for vertically moving said upper plate.

5. The paper slip transport and stack unit as claimed in claim 4, wherein:

said third transmission mechanism comprises a first one-way clutch for transmitting the rotational driving force only in the forward direction among rotational driving forces output from said motor;

a second one-way clutch for transmitting the rotational driving force only in the reverse direction among rotational driving forces output from said motor; and a mechanism for receiving the rotational driving forces transmitted via said first and second clutches as a common rotational driving force in the same direction, rotational driving force being always transmitted to said separation means in one direction by said mechanism for receiving a rotational driving force in the same direction.

6. The paper slip transport and stack unit as claimed in claim 2, wherein:

said second transmission mechanism has a one-way clutch for transmitting the rotational driving force only in the reverse direction among rotational driving forces output from said motor; and said paper slip lift means has an upper plate for supporting slips of paper and a mechanism for converting the rotational driving force transmitted from said second transmission mechanism into a vertical motion for vertically moving said upper plate, the rotational driving force in the reverse direction being transmitted via said one-way clutch to said mechanism for vertically moving said upper plate.

7. The paper slip transport and stack unit as claimed in claim 2, wherein:

said third transmission mechanism comprises a first one-way clutch for transmitting the rotational driving force only in the forward direction among rotational driving forces output from said motor;

a second one-way clutch for transmitting the rotational driving force only in the reverse direction among rotational driving forces output from said motor; and a mechanism for receiving the rotational driving forces transmitted via said first and second clutches as a common rotational driving force in the same direction, rotational driving force being always transmitted to said separation means in one direction by said mechanism for receiving a rotational driving force in the same direction.

8. The paper slip transport and stack unit as claimed in claim 1 further comprising:

a frame for housing said means, said transport means having a vertical transport section for transporting slips of paper in a substantially vertical direction, said vertical transport section comprising a conveyor belt and a press roller unit for putting a slip of paper between said belt and said press roller unit, said press roller unit comprising a plurality of press rollers each supported on a roller shaft for pressing a slip of paper;

a support plate mounted detachably on said frame for supporting the roller shafts of said plurality of press rollers movably to said conveyor belt;

press springs each installed for each of said roller shafts and engaging said roller shaft corresponding thereto for energizing said roller shaft toward said conveyor belt; and a slide plate engaging said support plate for placing said press springs in an energization state when said press roller unit is fitted into said frame and for releasing the energization state when said press roller Unit is removed from said frame.

9. The paper slip transport and stack unit as claimed in claim 1, wherein:

said transport means has a plurality of pulleys and a belt placed thereon.

10. The paper slip transport and stack unit as claimed in claim 9, further comprising:

an eject roller installed at a termination of said transport means for transferring slips of paper to said paper slip lift means while coming into rolling contact with said conveyor belt; and an elastic member disposed in parallel to said eject roller for springing up an rear end of a slip of paper to put the slip of paper under the preceding slip of paper while guiding slips of paper from the rear end of said transport means, said eject roller being made of a grooved elastic material having high friction.

* * * * *